US008475629B2

(12) United States Patent
Propst, Jr. et al.

(10) Patent No.: US 8,475,629 B2
(45) Date of Patent: Jul. 2, 2013

(54) COATING COMPOSITIONS COMPRISING ALKYL KETENE DIMERS AND ALKYL SUCCINIC ANHYDRIDES FOR USE IN PAPER MAKING

(75) Inventors: Charles W. Propst, Jr., Gettysburg, PA (US); James C. Jones, Maumee, OH (US)

(73) Assignee: Spectra Kote Corporation, Gettysburg, PA (US)

( * ) Notice: Subject to any disclaimer, the term of this patent is extended or adjusted under 35 U.S.C. 154(b) by 0 days.

(21) Appl. No.: 12/240,587

(22) Filed: Sep. 29, 2008

(65) Prior Publication Data

US 2009/0020249 A1 Jan. 22, 2009

Related U.S. Application Data

(62) Division of application No. 10/691,700, filed on Oct. 24, 2003, now Pat. No. 7,429,309.

(60) Provisional application No. 60/420,728, filed on Oct. 24, 2002.

(51) Int. Cl.

| | |
|---|---|
| ***D21H 17/34*** | (2006.01) |
| ***D21H 17/63*** | (2006.01) |
| ***D21H 17/66*** | (2006.01) |
| ***D21H 17/68*** | (2006.01) |
| ***D21H 23/22*** | (2006.01) |

(52) U.S. Cl.

USPC ..... 162/168.1; 162/158; 162/164.1; 162/181.1; 162/181.4; 162/181.5; 162/181.8

(58) Field of Classification Search

USPC ..... 162/181.1–181.8

See application file for complete search history.

(56) References Cited

U.S. PATENT DOCUMENTS

| | | | | |
|---|---|---|---|---|
| 2,726,230 | A | 12/1955 | Carlson | |
| 3,180,787 | A | 4/1965 | Adams | |
| 4,407,994 | A | 10/1983 | Bankert et al. | |
| 4,522,686 | A | 6/1985 | Dumas | |
| 4,847,315 | A | 7/1989 | Hassler | |
| 4,859,244 | A | 8/1989 | Floyd | |
| 5,114,538 | A * | 5/1992 | Malatesta | 162/158 |

(Continued)

FOREIGN PATENT DOCUMENTS

| | | |
|---|---|---|
| CA | 2354966 | 8/2001 |
| CA | 2354966 | 2/2002 |

(Continued)

OTHER PUBLICATIONS

Smook, Gary A., Handbook for Pulp and Paper Technologists, 2nd ed, Angus Wilde Publications, 1992, p. 228.*

(Continued)

*Primary Examiner* — Mark Halpern
*Assistant Examiner* — Dennis Cordray
(74) *Attorney, Agent, or Firm* — Novak Duce Connolly Bove + Quigg LLP

(57) ABSTRACT

Additives for paper making are disclosed herein. Specifically, the additives are wax-free alternatives to conventional coatings, including ASA, AKD and optionally an acrylic containing composition. Other additives may be included in the coating, such as cationic particles or compositions. The coatings may be used at a variety of points during the paper making process, including on the calender stack and in the wet end.

11 Claims, 2 Drawing Sheets

U.S. PATENT DOCUMENTS

| | | | | |
|---|---|---|---|---|
| 5,177,051 | A | 1/1993 | Hobson et al. | |
| 5,292,391 | A * | 3/1994 | Wallick | 156/205 |
| 5,362,573 | A | 11/1994 | Pandian et al. | |
| 5,393,566 | A | 2/1995 | Propst | |
| 5,397,436 | A | 3/1995 | Robeson et al. | |
| 5,429,294 | A | 7/1995 | Propst | |
| 5,531,863 | A | 7/1996 | Propst | |
| 5,603,997 | A | 2/1997 | Lindgren et al. | |
| 5,824,190 | A | 10/1998 | Guerro et al. | |
| 5,858,081 | A * | 1/1999 | Thompson et al. | 106/486 |
| 5,858,173 | A | 1/1999 | Propst | |
| 5,876,562 | A | 3/1999 | Johansson | |
| 5,885,340 | A | 3/1999 | Bailey et al. | |
| 5,961,708 | A | 10/1999 | Zetter et al. | |
| 6,103,861 | A | 8/2000 | Staib et al. | |
| 6,153,040 | A | 11/2000 | Rohlf et al. | |
| 6,159,339 | A | 12/2000 | Hassler et al. | |
| 6,171,444 | B1 | 1/2001 | Nigam | |
| 6,171,680 | B1 | 1/2001 | Fahmy | |
| 6,207,258 | B1 * | 3/2001 | Varnell | 428/32.1 |
| 6,248,164 | B1 * | 6/2001 | Hakansson | 106/287.2 |
| 6,261,679 | B1 | 7/2001 | Chen et al. | |
| 6,273,997 | B1 | 8/2001 | Ehrhardt et al. | |
| 6,284,099 | B1 * | 9/2001 | Peutherer et al. | 162/158 |
| 6,315,824 | B1 * | 11/2001 | Lauzon | 106/287.2 |
| 6,348,132 | B1 * | 2/2002 | Zhang et al. | 162/158 |
| 6,414,055 | B1 | 7/2002 | Lauzon | |
| 6,551,457 | B2 | 4/2003 | Westman et al. | |
| 6,576,049 | B1 | 6/2003 | Dilts et al. | |
| 2002/0062938 | A1 * | 5/2002 | Westman et al. | 162/206 |
| 2003/0124316 | A1 | 7/2003 | Huang et al. | |

FOREIGN PATENT DOCUMENTS

| | | |
|---|---|---|
| EP | 0499448 | 8/1992 |
| EP | 0499448 | 11/1992 |
| WO | 9735068 | 9/1997 |
| WO | WO-9735068 | 9/1997 |
| WO | 9737079 | 10/1997 |
| WO | WO-9737079 | 10/1997 |
| WO | WO 00/52709 A1 * | 9/2000 |
| WO | 0188262 | 11/2001 |
| WO | 0225013 | 3/2002 |
| WO | WO-02/25013 | 3/2002 |

OTHER PUBLICATIONS

Technical Bulletin; 1984; S.C. Johnson & Son, Inc., Racine, WI 53403.

* cited by examiner

COATING COMPOSITIONS COMPRISING ALKYL KETENE DIMERS AND ALKYL SUCCINIC ANHYDRIDES FOR USE IN PAPER MAKING

This application is a divisional application of U.S. application Ser. No. 10/691,700, filed Oct. 24, 2003, now U.S. Pat. No. 7,429,309, issued Sep. 30, 2008; which claims priority from U.S. Provisional Application No. 60/420,728, filed Oct. 24, 2002, both incorporated by reference in their entirety.

BACKGROUND

1. Field of the Invention

The present invention is directed to the papermaking arts, more particularly to a process for the manufacture of a paper having improved grease and water resistance and increased tensile strength, yet facilitating recycling of the paper. Such papers (throughout the specification and claims "papers" includes virgin or recycled paper, kraft stock and similar materials) find particular application in the container making art wherein such improved properties are desirable. The container making art, particularly, in the field of corrugated containers, folding cartons, and the tray and box industries, consumes much of the natural timber resources. Thus, it would be beneficial to formulate new processes of forming papers of improved wet strength having grease and water resistance properties as well as increase tensile strength which papers would be repulpable and therefore recyclable.

2. Description of the Related Art

The art of "papermaking" is an ancient one, being attributable to invention by the Chinese before the birth of Christ.

As far back as containers have been needed, the use of wood has been the most popular, and has the longest history. Containers in the shape of barrels and crates have traditionally been used to carry and/or store many varied types of materials, including wet products such as produce, fish, meat, and poultry. This of course is not the limit to the requirements of packing wet or refrigerated products as there are many more wet packed products that contain water and ice or condensation from refrigeration to retard the ripening process or to maintain product freshness for distribution over wide geographical areas.

In order to reduce costs, wooden crates were reused as many times as possible. For some products this caused health issues, because bacteria often grow on the surface of wood or in the cracks of the wood. As a result, crossover contamination of bacteria or viruses, such as salmonella, was common, from one crate to another, as proper sanitation was often not performed.

The use of corrugated paper began to mature in the 1930's and 1940's as the container of choice for lightweight items. As the technology increased and the ability to make corrugated boxes out of heavier or thicker paper (or liner), the strength of the corrugated box increased. The corrugation strength of paper was demonstrating strengths that the wood crate manufacturers did not expect. The confidence of the corrugated suppliers along with the innovative minds in the corrugated industry caused a new concept to be considered to perhaps penetrate the wet container market against the wooden crate. This was the introduction of the wax coated corrugated box. If the corrugated box coated with wax could be designed to hold products safely and in vertical stacking stresses that exceed 250 lbs., perhaps the wax would keep the paper/liner dry which would in turn keep the box rigidity and strength as high as in the dry environment, and thus replace the wooden crate. However, in order to increase the strength of a conventional corrugated box, it became necessary to use heavier and thicker paper.

As a result of the superior properties of corrugated paper containers, wood crates were slowly phased out. The wooden crate was pushed out of every market in which the corrugated paper box was suitable for use. Since the 1940's, the wax coated box has done an excellent job of supplying boxes for storing items such as produce, fish, meat and poultry.

More modern developments resulted in the widely accepted Fourdrinier process (See generally Kirk-Othmer Encyclopedia of Chemical Technology, 3rd ed., Vol. 9, pp. 846-7, John Wiley & Sons, New York 1980, herein incorporated by reference in its entirety), in which a "furnish" (a "furnish" is predominantly water, e.g., 99.5% by weight and 0.5% "stock", i.e., virgin, recycled or mixed virgin and recycled pulp of wood fibers, fillers, sizing and/or dyes) is deposited from a headbox on a "wire" (a fast-moving foraminous conveyor belt or screen) which serves as a table to form the paper. As the furnish moves along, gravity and suction boxes under the wire draw the water out. The volume and density of the material and the peed at which it flows onto the wire determine the paper's final weight.

Typically, after the paper leaves this "wet end" of the papermaking machine, it still contains a predominant amount of water. Therefore, the paper enters a press section, generally comprising a series of heavy rotating cylinders, which press the water from the paper, further compacting it and reducing its water content, typically to 70% by weight.

Thereafter, the paper enters a drying section. Typically, the drying section is the longest part of the paper machine. For example, hot air or steam heated cylinders may contact both sides of the paper, evaporating the water to a relatively low level, e.g., no greater than 10%, typically 2-8% and preferably 5% by weight of the paper.

Following the drying section, the paper optionally passes through a sizing liquid to make it less porous and to help printing inks remain on the surface instead of penetrating the paper. The paper can go through additional dryers that evaporate any liquid in the sizing and coating. Calenders or polished steel rolls make the paper even smoother and more compact. While most calenders add gloss, some calenders are used to create a dull or matte finish.

The paper is wound onto a "parent" reel and taken off the paper making machine.

The paper on the parent reel can be further processed, such as on a slitter/winder, into rolls of smaller size or fed into sheeters, such as folio or cut-size sheeters, for printing end uses or even office application.

In order to make conventional containers, rolls formed by slitter/winder (e.g., of paper and kraft grades of liner) are unwound and coated with a wax. Waxes are used to impart water resistance and wet strength to the liner, but prohibits or otherwise inhibits recycling the used containers incorporating them. Additionally, conventional wax coated liners must be adhered to the other components of the container with hot melt adhesives. Most hot melt adhesives are a further impediment to recycling of formed containers because they employ wax containing components. Thus, there still exists a need for manufacturing paper possessing superior wet and tensile strength and water and grease resistance properties, but facilitating repulping and recycling thereof.

Two methods for coating boxes or other paper products with liquid additives, such as wax, are conventionally used. The first is identified as a curtain coating process. This design incorporates a medium that is impregnated with hot wax and then becomes a corrugated box. A completed, i.e., combined, board is passed through a curtain of hot wax, in a procedure commonly known in the art of paper making as "curtain coating." First one side and then the opposite side are coated with hot wax. However, due to the conditions necessary to perform the curtain coating process, fire becomes a significant risk.

Another conventional paper coating process is "cascading" The cascading wax procedure is different from the curtain coating procedure in that a regularly corrugated box of any shape or size can be stood on end, such that the corrugated flutes are vertical, to allow the hot wax to permeate the entire structure, with a wax cascading around and through the container in a flat position that is easy to stack for shipping. In contrast to the curtain coating process, the cascading process requires the box to be fully formed prior to application of the wax or other liquid additive. This is considered the better performing wax box of the two described.

Alternative coating procedures are also known in the art, such as those described in U.S. Pat. Nos. 5,858,173; 5,531,863; 5,429,294; and 5,393,566, each of which is herein incorporated by reference in its entirety, for example, surface coating to protect the outside of the liner on both sides to mimic a box subjected to the curtain coating procedure.

Moreover, substitutes for wax coatings have been developed. For example, U.S. Pat. No. 5,393,566 discusses the use of acrylic on the paper machine to generate a moisture barrier. Even with the coated one side liner with the medium included in the design, the acrylic-coated boxes, described therein, equaled the performance of conventional wax coated boxes, coated via the cascade method.

End users of conventional wax boxes are often faced with exorbitant charges for disposal fees, which can often exceed $80/ton of box waste. Because the coatings of the invention may be applied at any existing paper mill, such costs can be reduced to a one time sale of $70/ton, for a total cost savings is $150/ton at current pricing which is significant to national grocers. This industry is what is driving the demand for a solution to the waxed container that has given reliable service for about 60 years.

SUMMARY OF THE INVENTION

The present inventor has discovered that amounts of AKD or ASA as an additive, either alone or in combination with other known additives, could create the wax free technologies of the future.

In order to overcome the problems associated with conventional paper coatings, while still maintaining moisture resistance, the present invention includes the addition of at least one hydrocarbon dimer, such as alkyl ketene dimer (AKD), and/or alkyl succinic anhydride (ASA), for example, in the size press or calendar stack and most often in the wet end. Thus, a medium is created that outperforms waxed medium in laboratory testing for burst and tear strengths, and water resistance. As used herein, "AKD" may also be alkenyl ketene dimer, in addition to the alkyl ketene dimers discussed above.

The specific coatings of the invention have equaled or exceeded conventional wax boxes used, for example, refrigerated or other wet strength environments, such as in poultry packaging. Generally, conventional waxed boxes last approximately 6-9 days in wet environments such as heavy ice packs, because even with wax as a water barrier, the liner still becomes wet over time. However, applying a coating composition comprising AKD and/or ASA in the wet end of the paper making process provides a useable life that meets or exceeds that of waxed boxes. Additionally, the boxes of the present invention can last 1-2 months for long term storage, such as under refrigerated conditions. e.g., 34° F. and high humidity and without ice.

This success has prompted the inventors to consider the same formulation at the paper machine for liner. This would revolutionize the efficiencies and the economics of the entire cost structure and make wax alternative technology the unmistakable choice for performance, cost and the environment.

No one has considered this approach before because a typical mill engineer would test the water drop of the liner or medium and assume that with such water resistance, that no one could corrugate the board, when the board is combined with any water based corn starch, which must first have been bound to the two liners and the medium. The coated boards of the invention also pass such tests as dry pins and wet pins. Wet pins are tested after the corrugated board has been submerged in water at room temperature for 24 hours and not only stay together but also offer a measurable resistance from being pulled apart. The inventor has studied the use of starches, such as ordinary corn starch, potato starch, wheat and tapioca, as binding and sizing agents. Thus in combination with one or more additives, AKD and/or ASA treated materials can replace conventional wax liners.

In one embodiment the invention is directed to a process for making paper wherein a furnish is deposited on a wire and dewatered, wherein to the furnish is added a recyclable plastic coating composition comprising alkyl ketene dimer (AKD) and/or alkyl succinic anhydride (ASA), either alone or in combination with other additives or sizing agents, such as acrylics.

In another embodiment, the invention is directed to a process for making paper wherein a furnish is deposited on a wire and dewatered to form a paper, and the dewatered paper is subsequently pressed a number of times to further reduce the water content of the paper, characterized in adding a recyclable plastic coating composition, the coating comprising alkyl ketene dimer (ASA) and/or alkyl succinic anhydride (ASA), to at least one side of the dewatered paper subsequent to a first pressing step.

In a still further embodiment, the invention is directed to a process for making paper wherein a furnish is deposited on a wire and dewatered, the dewatered paper is subsequently pressed to further reduce the water content of the paper and subsequently calendered, characterized in introducing to at least one side of the paper a recyclable plastic coating composition, comprising alkyl ketene dimer (ASA) and/or alkyl succinic anhydride (ASA), between the pressing and calendering steps.

A further embodiment discloses a process for making paper characterized in the following steps:

(a) applying a furnish to a wire, (b) dewatering the furnish and obtaining a water containing paper, (c) pressing the water containing paper to reduce the water content, (d) calendering the pressed paper, (e) recovering a finished paper, and (f) adding a recyclable plastic coating, coating composition comprising alkyl ketene dimer (ASA) and/or alkyl succinic anhydride (ASA) at any step during the paper making process.

DETAILED DESCRIPTION OF THE INVENTION

Figure 1:
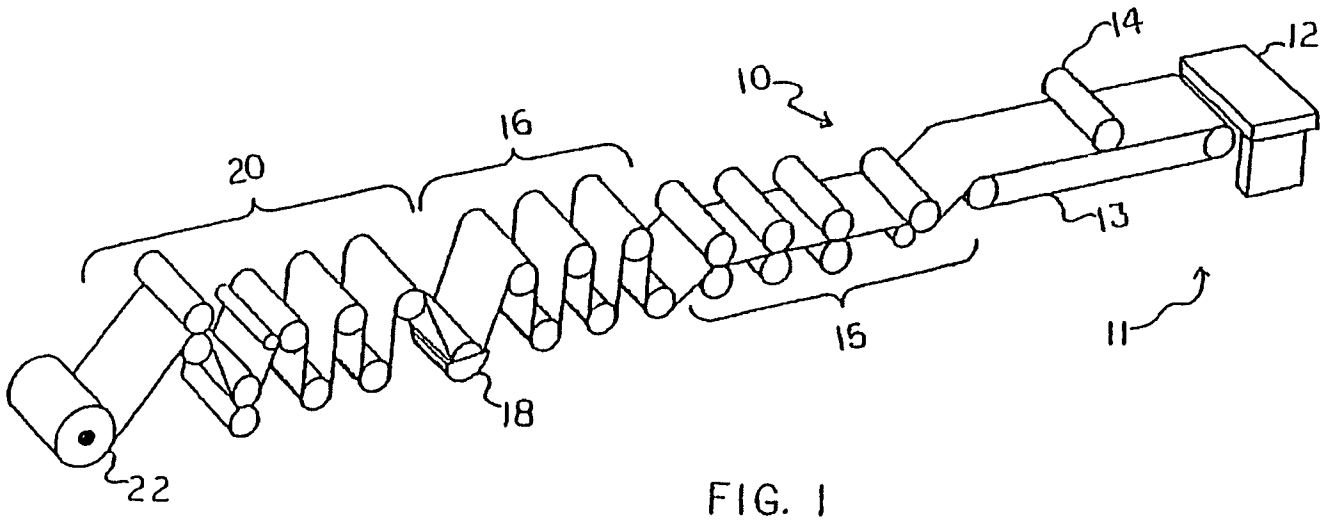
FIG. 1 is a perspective, schematic view of a typical papermaking machine.

A paper making machine in accordance with the invention is illustrated generally at 10 in FIG. 1. Typically, the paper making machine 1 comprises a "wet end" 11 including a headbox 12, a wire 13 and a press section 15, a drying section 16, a size press 18, calender section 20 and parent reel 22. Optionally, a dandy roll 14 is positioned about two thirds of the way down the wire to level the fibers and make the sheet more uniform. Gravity and suction boxes (not shown) are positioned underneath the wire to remove water from the furnish.

The stock fed to the headbox 12 can be virgin, recycled or a mixture of virgin and recycled pulp. In the headbox 12, the stock is mixed with water to form a furnish for deposit onto the wire 13.

1. The RPC

In the invention, a recyclable plastic coating composition (RPC), comprising alkyl ketene dimer (AKD) and/or alkyl succinic anhydride (ASA) is incorporated during the papermaking process. It should be understood that in this invention and throughout the specification and claims, "coating" means "coating" or "impregnation" unless otherwise indicated.

A. Acrylic Acid Containing Material

For example, a typical RPC composition is an aqueous acrylic acid containing material, such as homopolymers or copolymers of acrylic acid (for example, methacrylic acid, ethylacrylic acid, polyacrylic acid, crotonic acid, isocrotonic acid, pentenic acid, C (1-4) alkyl substituted acrylic acid, and other acrylic acids, such as butyl, amyl, octyl and hexadecyl, methylacrylate vinyl acetate, vinyl chloride, vinylidene chloride, isobutylene, vinyl ethers, acrylonitrile, maleic acid and esters, crotonic acid and esters, itaconic acid, and BASOPLAST 400 DS, BASOPLAST 250 D, BASOPLAST 335 D, and BASOPLAST 265 D available from BASF Corporation of Mount Olive, N.J.) resin based composition, comprising an acrylic homopolymer or copolymer, such as ethylene acrylic acid copolymer, in combination with alkyl ketene dimer (AKD) and/or alkyl succinic anhydride (ASA). Additionally, aqueous dispersions of acrylic ester copolymers are considered as suitable acrylic containing components, such as ACRONAL NX 4787, ACRONAL S 504 and ACRONAL S 728, available from BASF Corporation. As used throughout the specification and claims, references to "acrylic acid" and "acrylic acid containing" refer to materials and compositions, such as polymers, oligomers, or monomers, comprising at least one acrylic or acrylic acid moiety. Other typical acrylic acid containing solutions include JONCRYL 52, JONCRYL 56, JONCRYL 58, JONCRYL 61, JONCRYL 61LV, JONCRYL 62, JONCRYL 67, JONCRYL 74, JONCRYL 77, JONCRYL 80, JONCRYL 85, JONCRYL 87, JONCRYL 89, JONCRYL 91, JONCRYL 95, JONCRYL 503 and JONCRYL M-74, each of which is available from Johnson Wax Specialty Chemicals of Racine, Wis.

With respect to the acrylic acid containing material used in the invention, any conventionally known acrylic acid containing monomer, dimer or oligomer may be used, either alone or in combination with any number of other acrylic acid containing or non-acrylic acid containing monomer, dimer or oligomer.

B. Ketene Dimers

Ketene dimers used as cellulose reactive sizing agents are dimers having the formula: $R(CH{=}C{=}O)_2$, where R is a hydrocarbon radical, such as alkyl having at least 8 carbon atoms, cycloalkyl having at least 6 carbon atoms, aryl, aralkyl and alkaryl, and decyl ketene dimer. Examples of suitable ketene dimers include octyl, decyl, dodecyl, tetradecyl, hexadecyl, octadecyl, eicosyl, docosyl, tetracosyl, phenyl, benzyl, beta-naphthyl and cyclohexyl ketene dimers, as well as the ketene dimers prepared from montanic acid, naphthenic acid, $\Delta^{9,10}$-decylenic acid, $\Delta^{9,10}$-dodecylenic acid, palmitoleic acid, oleic acid, ricinoleic acid, linolenic acid, and eleostearic acid, as well as ketene dimers prepared from naturally occurring mixtures of fatty acids, such as those mixtures found in coconut oil, babassu oil, palm kernel oil, palm oil, olive oil, peanut oil, rape oil, beef tallow, lard (leaf) and tall oil. Mixtures of any of the above-named fatty acids with each other may also be used. Such ketene dimers are described in U.S. Pat. No. 4,407,994, herein incorporated by reference in its entirety. An additional sufficient ketene dimer is sold under the tradename AQUAPEL, by Hercules, Inc., of Wilmington, Del. Further ketene dimers include alkyl, alkenyl, aryl, and alkaryl ketene dimers. Optionally, the ketene dimers are provided with a cationic starch to assist in binding to the cellulosic constituents.

However, any ketene dimer is adequate. For example, the dimer may be a simple 13,-cyclobutadione or a unsaturated β-lactone, examples of which are provided in Kirk-Othmer Encyclopedia of Chemical Technology (3rd ed., Vol. 9, pp. 882-7, John Wiley & Sons, New York 1980), herein incorporated by reference in its entirety.

C. Alkenyl Succinic Anhydride

Alkenyl succinic anhydride is typically produced from the reaction of an olefin with maleic anhydride. The maleic anhydride molecule supplies the reactive anhydride functionality to the ASA, while the long chain alkyl portion provides the hydrophobic properties associated with this size. The resulting succinic anhydride group is extremely reactive, and will complex with hydroxyl groups on cellulose, starch and water. It is the ASA molecule's high reactivity that provides some of its major advantages.

Due to the reactivity of ASA, the coating compositions incorporating ASA will readily cure on the paper machine without excessive drying or the use of promoters. As a result, most of the cure is achieved before the size press, allowing the machine to be run at similar moisture contents than those experienced under acid conditions, thus giving greater control of starch pick-up can be realized at the size press, resulting in full sizing at the reel and improved productivity.

The tendency of the ASA molecule to react with water presents additional advantages. The ASA forms a di-acid, which is hydrophilic at one end of the molecule and hydrophobic at the other end. The di-acid has the ability to react with metal ions such as calcium or magnesium that are often found in water systems. The products of these reactions are sticky precipitates, and have the potential to deposit on the fabrics and frame of the paper machine, although it has been shown that a calcium salt can contribute to sizing. An aluminum salt is much less tacky however, and the presence of an aluminum source in the system is consequentially of great benefit. This ability to react with metal ions has been exploited in some mills, notably in Japan, where a potassium salt of a low molecular weight ASA is made and then precipitated onto the fiber using alum at acid pH in much the same way as rosin is used.

Any ASA may be used in the invention. Commercial sizing agents based on ASA compounds are typically prepared from maleic anhydride and one or more appropriate olefins, generally C(14) to C (22) olefins. ASA compounds prepared from maleic anhydride and C(16) internal olefins, C(18) internal olefins, and mixtures of C (16) and C (18) internal olefins, are among the more widely used ASA compounds, as described in U.S. Pat. No. 6,348,132, herein incorporated by reference in its entirety.

D. Crosslinking Agent

When an acrylic acid containing material is included in the RPC, an optional crosslinking agent is typically provided in an amount sufficient to crosslink the acrylic acid containing material. Although any substance capable of at least partially crosslinking the acrylic acid containing material is sufficient, often organic or inorganic substances including zinc, titanium or magnesium are used. Preferred however, are zinc oxide, aluminum oxide, ammonium oxide, calcium oxide, magnesium stearate, magnesium oxide, isostearate (e.g., 4-isostearate), stannous oxide, tungsten oxide, titanium oxide, and various mixtures, emulsions and compositions including one or more of the oxides. In one embodiment, the crosslinking agent includes a salt (as described herein) plus a butyric acid and 5-carbon acids, such as isovaleric, 2-methylbutyric and n-valeric acids. Other typical FDA approved cross linking agents include zinc octoate, zinc salts of fatty acids, zirconium oxide, calcium isosterate, calcium stearate, aluminum stearate, sodium tungstate, sodium tungstate dihydrate, calcium salts of fatty acids, magnesium salts of fatty acids, and aluminum salts of fatty acids. Generally, the fatty acids are fatty acids of animal and/or vegetable fats and oils, and would be exempt from being kosher compliant, since the potential use of animal oils and the original of the animal in question may be unspecified. In such cases, the inorganic substances would be preferred. It is considered within the scope of this invention to incorporate more than one substance to form the crosslinking agent. However, as used throughout the description and claims the term cross linking agent includes the above described compositions, as well as heat, radiation or any other method for initiating a crosslinking reaction in the acrylic containing resin. Other suitable crosslinking agents include Zinc Oxide Solution #1, available from Johnson Wax Specialty Chemicals of Racine, Wis. For example, a typical (RPC) composition is an aqueous acrylic resin based composition. A preferred three-component composition contains the composition disclosed by U.S. Pat. No. 5,393,566 (hereinafter "the '566 patent"), modified by the addition of ASA and/or AKD. For example, compatible compositions contain anywhere from 0-100% ASA or AKD, with the remainder consisting of the acrylic acid resin containing composition of the '566 patent. Typical compositions can include the following, by weight percent, anywhere from 0-100%, typically 25-75% and more typically, 25-30% ASA; from 0-100%, typically 25-75 and more typically 25-30% AKD; with the remainder being the acrylic acid containing composition of the '566 patent, typically 1-99%, more typically, 1-10% or 10-40%.

E. MEA $NH_4OH$ may also be added to the RPC as a pH regulator for blending/dissolving/dispersing of the resins and emulsions and dispersions of acrylics. However, often, in order to remove undesired characteristics of the RPC, produced by the ammonium hydroxide, monoethanolamine (MEA) can be substituted for both toll coaters and mill environments. The heat of the paper mill has exasperated the volatility of ammonium hydroxide causing more discomfort in producing wax alternative medium and liners. When substituting $NH_4OH$ with MEA in a one to one replacement (by weight) the odor is reduced if not removed and the performance is equal if not slightly better. However, it is also considered within the scope of this invention to substitute MEA for $NH_4OH$ anywhere from 0.5-2.0 to 1 by weight, preferably, 1.5:1, i.e., 50% more MEA for every gram of $NH_4OH$. Generally, $NH_4OH$ is delivered in a 28% aqueous solution, i.e., the highest concentration commercially available. Although any alkanolamine may be used, MEA is preferred.

F. Alumina-Silica

Moreover, clay powders comprising, for example, $Al_2Si_2$ (Alumina-Silica) may be used as an additive to the wax free formulae of this invention. The addition of minerals to the formula has proven to be multifaceted in its benefits. First of all, it has lowered Moisture Vapor Transmission Rate (MVTR, a measure of the passage of water vapor through a barrier) numbers into the range that will permit the substitution of our product as a replacement of wax or polyethylene for long-term storage of copy paper which is sensitive to temperature and moisture changes. More often moisture, but with the moisture capacity of the atmosphere directly affected by temperature both must be identified for the total severe environment that ream wrap and bulk boxes must address to protect copy paper from becoming distorted from moisture thus rendering the paper unfit for use in a copy machine and resulting in a credit from the paper producer. Alumina Silica, Calcium Carbonate, Titanium Dioxide are all satisfactory for use in this type of performance. Without a mineral additive the MVTR rating is approximately 30 $gm/m^2$, for 24 hours. With an addition of 8% mineral, most preferably Alumina/Silica, the MVTR drops to numbers under 15 gm/m2 which is the accepted target for ream wrap and bulk boxes for copy paper and other papers in larger dimensions that are made under the same conditions and requiring the same sort of performance. Alumina/Silica is preferred because it works as well any mineral and suspends in the formulae of this invention satisfactorily and is the least costly of the several minerals available on the market. Additionally the heat resistance and the potential concerns of re-softening while bonding on the corrugator has reduced immensely. So with the hardening of the coated surface above the levels generated in the cross linking actions has also caused a greater receptiveness to the product by the corrugator operators. This benefit has occurred without detriment to the surface for receiving water based inks and bonding performance of cold set adhesives or hot melt adhesives.

II. Method of Applying the RPC

The inventor has discovered that a product having superior water-proof properties results when the RPC of the invention is added to Kraft, linerboard or medium, whether incorporated as a coating, at the wet-end, in the furnish, calender, or press. When Kraft, linerboard or medium is used, in one embodiment, a starch containing component is often incorporated to achieve the elevated water-proof properties. Such starch containing components may include ordinary corn starch, potato starch, wheat or tapioca starches. Using the RPC of the invention with a starch containing component does not affect the bonding performance of the starch when making products, such as corrugated board, could lead to concentrations high enough that the use of acrylic acid containing material at the size press or the wet end could be eliminated completely.

Within the laboratory environment, liner board was repulped to conform with the consistency of pulped fiber processed in an average paper mill machine. At this point, the fiber was separated into four separate beakers each with 100 grams of fiber. To beaker number 1, 5.0 grams of RPC-1 (described below) was added. In beaker number 2, 10.0 grams of RPC-1 was added. In beaker number 3, 20.0 grams of RPC-1 was added. In beaker number 4, 30.0 grams of RPC-1 was added.

After stirring the fiber mixed with RPC at various levels, the fiber from each beaker was applied to a wire mesh which would simulate the wire mesh of a paper machine which allows the fiber to drain by gravity or assisted through a particle vacuum action that starts the removal of fluids on the paper machine. Through gravity and compression in the laboratory environment, excess fluids were driven out of the fiber of each test sample, one through four. To simulate paper machine drying the fiber, still on the wire mesh, was dried by infra-red heat. After all four test samples were dried, the surfaces were tested for grease resistance and water resistance. A fifth sample was repulped, screened and dried without any RPC to be the control. Samples one through four showed improved grease and water resistance when compared to the control. The final phase was to repulp samples one through four, rescreen and dry. The final step in the process to determine success is examining the dry reformed paper under a microscope to determine the presence of undissolved foreign matter that would indicate a failure to repulp. The examination revealed that no undissolved material was present, indicating success in creating a barrier and having the barrier, RPC, dissolve and allow no foreign matter to be present in any beaker marked one through four. The foregoing experiment is indicative of addition of RPC to the stock or furnish prior to deposit on the wire of a paper making machine.

The next step in taking the invention from the laboratory to a commercially viable process was to introduce the RPC at different locations in conventional paper making machines.

II. Testing Runs

A position on the paper machine downstream of the headbox 12 was selected for a manual "pour on" of liquid RPC on an edge of the paper approximately 24 inches (58.8 cm) of the width of the paper machine, in the amount of 5 gallons (18.92 L). This section of treated paper was tracked through the paper machine and retrieved at the dry end of the machine. This retrieval section was tested for grease and water resistance and wet-strength and additionally showed improvement in each area.

RPC was next applied with a spraybar, the application rate applied from a minimum value, but sufficient to create perceptible enhancements to liner or medium, to approximately 40% by weight of paper, pH varied from 5.5 to 8.0.

The RPC was applied at the wet end via spray application to the top side of the sheet during a run of 26# medium. The trial spray head was positioned at:

(1) the wet/dry line on the wire, and (2) after the second press, before the dryer.

Subsequently, the RPC-1 was applied via calendar stock treatment to a 69# special liner. The purpose of this trial was to ascertain the viability of this application technique utilizing two water boxes on one side. The results of this latter trial is shown in Table I:

TABLE I

| 69# Special Liner | | | |
|---|---|---|---|
| | Reg. 69# Liner | Treated One Side | Treated Two Sides |
| Basis Wgt (lbs) MSF | 69 | 69.1 | 69.8 |
| Caliper | 19.0 | 20.0 | 19.5 |
| STFI MD | 128 | 118 | 120 |
| CD | 46-69 | 52 | 65 |
| Cobb 1-min T/B gms | — | 0.37/0.17 | 0.20/0.06 |
| Scott polyblend | — | 95 | 100 |
| Porosity (sec) | 8 | 700+ | 1200+ |

Figure 2:
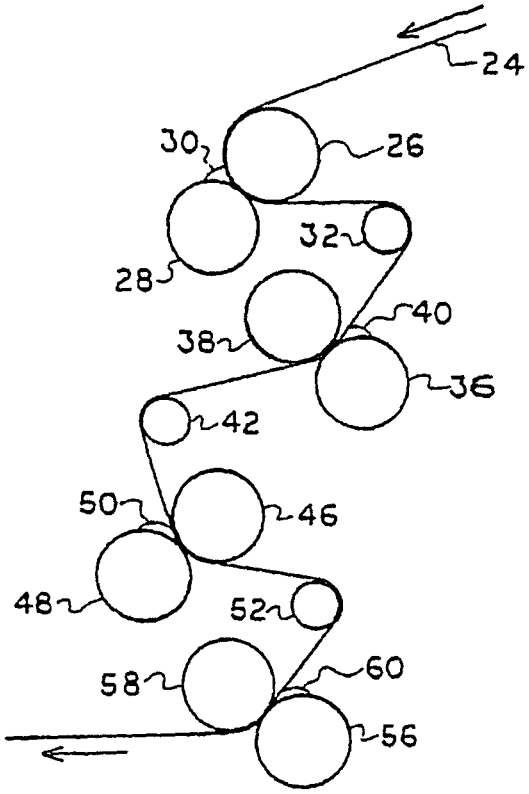
FIG. 2 is a schematic, side view of an alternative coating method.

Alternatively, as shown in FIG. 2, coating on both sides of a moving paper web 24 can be effected by passing web 24 between the nip of rollers 26, 28 in which a bank 30 of RPC is found thereby applying the RPC to one side of web 24. After passing over idler roll 32, the other side of the web 24 can be coated by bank 40 and rollers 36, 38. Additional layers of coating may be applied one or more times to either or both sides of web 24 by additional rollers 46, 48, 56, 58 and banks 50 and 60. Additional idler rolls 42, 52 may be provided to convey and tension web 24. The device of FIG. 2 can be used prior to, subsequent to, or in place of size press 18 of FIG. 1. It should be understood that additional rollers (not shown), banks (not shown) and even idler rolls (not shown) may be employed to apply as many additional layers of RPC as desired. Additionally, sizing agents may be incorporated into one or more of the banks of RPC.

All of the foregoing tests produced a paper that was repulpable. Thus, corrugated boxes and components thereof can be recycled even when such boxes have been made water and grease resistant, i.e., combined with the RPC of the invention. In addition, the addition of RPC appears to dramatically increase fiber strengths. Using 100% recycled fiber treated with RPC increased fiber strengths, giving strengths of 90% of virgin fiber, whereas normal recycled fiber are approximately 60% of virgin fiber. However, in commercial embodiments, the RPC may be used in amounts such as approximately 0.5-10 dry lbs. per ton of paper, typically approximately 1-5 dry lbs. per ton, and preferably approximately 3 dry lbs. per ton. For example, approximately 3.5 dry lbs. may be incorporated into the wet end of the paper machine for medium, and approximately 7.0 dry lbs. per ton can be used for commercial production runs of liner. Thus, the inventor has discovered that higher amounts of AKD and/or ASA can be used, such that the use of an acrylic acid containing composition at the wet end can be eliminated completely.

The process of paper making can be modified to include RPC addition at the headbox (or even upstream of the headbox when the stock is mixed with fillers, sizing or dyes), in the press section at any point subsequent to the first press, and subsequent to the drying section, either at or in place of the size press but before the calenders.

The following Table II shows some types of papers which can be treated by the invention

TABLE II

| Types of papers to be treated by the invention | |
|---|---|
| (a) | liner |
| (b) | medium |
| (c) | kraft |

The papers coated by the process find special use in the following industries, the label industry, especially the 60 lb./3000 $ft^2$ label industry, folding carton, tray and box (all board weights) and liquid packs, such as water, soda, and milk, ice cream, yogurt and delicatessen carry-out containers.

The fine paper industry for barrier containers and interleaves for between sensitive paper or metallized papers or photographic plates can also benefit from the invention.

By using the invention to apply a coating formulation into a paper making machine, the following benefits are achieved:

(1) the overall cost of the finished coated/impregnated liner or paper is reduced, and (2) incorporating the technology into the paper making machine (process) would allow the technology to reach its maximum potential.

The coated materials of the invention also pass the Edge Wick Test. A strip of medium or liner to be tested is cut into a 1 inch by 6 inch square and stood in ⅛ inches of water. Conventional medium will pull water into the structure, but the incorporation of ASA and/or AKD, and optionally an acrylic acid containing substance, eliminates or significantly reduces such "edge wicking". Since dry fibers are known to be stronger than wet fibers, by not absorbing water, the medium of the invention has shown it can maintain its strength even in wet environments.

Additionally, the coated materials of the invention have stacking strengths at least as great as conventional wax coated materials. Stacking strength is measured via the Edge Crush Test, wherein the materials are placed in a high humidity and low temperature environment and crushed with test equipment as described by TAPPI Test Method T811 "Edgewise compressive strength of corrugated fiberboard (short column test)", herein incorporated by reference in its entirety and included as Appendix I. This test resulted in the data provided as Table III, showing Edge Crush of corrugated board and the resulting retention percentage of vertical strength after being subjected to the humidity.

TABLE III

| Edge Crush (lbs/ln) | | | | | |
|---|---|---|---|---|---|
| | 50% RH, 73° F. | | 80% RH, 90° F. | | |
| | Avg. | σ | Avg. | σ | Retention % |
| Wax Dip | 98.2 | 4.50 | 71.9 | 2.90 | 73.2 |
| Curtain Coated | 55.60 | 3.10 | 41.80 | 1.80 | 75.2 |
| Sample 1 | 56.5 | 1.9 | 42.8 | 1.90 | 75.7 |
| Sample 2 | 61.4 | 1.80 | 46.00 | 2.10 | 74.9 |
| Sample 3 | 67.3 | 2.50 | 51.30 | 2.40 | 76.2 |

In this test, and in all tests described herein, "Wax Dip" refers to conventional fully wax impregnated cabbage boxes; "Curtain Coated" refers to bell pepper boxes, curtain coated on both sides with conventional wax containing coatings; while Samples 1-3 are three separate runs of paper products according to the invention.

Paper products according to the invention also show similar pin adhesion properties, when measured according to Test Method T 821 om-96: "Pin Adhesion of Corrugated Board by Selective Separation", herein incorporated by reference in its entirety, as shown by the data in Table IV.

TABLE IV

| Pin Adhesion (lbs/24 Ln in) | | | | | | | | | |
|---|---|---|---|---|---|---|---|---|---|
| | Combined | @ Standard Conditions | | | | @ Wet (24 hour soak) | | | |
| | Weight (lbs/ | Single-Face | | Double-Face | | Single-Face | | Double-Face | |
| | MSF) | Avg. | Σ | Avg. | σ | Avg. | σ | Avg. | σ |
| Wax Dip | 220.8 | 189.6 | 5.6 | 144.7 | 5.6 | 50.4 | 2.2 | 17.7 | 1.1 |
| Curtain Coated | 177.6 | 123.6 | 7.0 | 117.7 | 3.2 | 5.1 | 0.7 | 9.3 | 0.9 |
| Sample 1 | 164.4 | 124.6 | 5.4 | 88.9 | 14.9 | 5.8 | 0.2 | 6.4 | 1.2 |
| Sample 2 | 188.2 | 158.9 | 6.2 | 120.0 | 2.0 | 15.2 | 1.2 | 15.2 | 1.5 |
| Sample 3 | 200.7 | 137.6 | 3.7 | 133.7 | 3.4 | 10.6 | 1.9 | 16.9 | 1.5 |

As used in Tables III and IV, Sample 1 is 26# medium with 69# liner on both sides. Sample 2 is 35# medium with 74# liner on both sides. Sample 3 is 25# medium with 90# liner on both sides. Each of the liners are coated or treated as described above, having received 2.0-2.2 dry lbs./1000 $ft^2$ of RPC-1. The mediums for Table VII received 0.5-1.0 dry lbs/1000 $ft^2$ of RPC-1.

A Ring Crush Test (RCT) of paperboard (as described by TAPPI Test Method 822, herein incorporated by reference in its entirety), 26# 100% recycled medium, formed in accordance with the invention showed superior properties over untreated medium, as shown in Table V for fibers oriented in the machine direction (MD) and Table VI for fibers oriented in the cross direction (CD). For each test, a ½" by 6" sample was stipsplaced in special ring shaped holders and crushed by the testing equipment.

TABLE V

| Untreated 26# medium | | | | | | |
|---|---|---|---|---|---|---|
| Sample | α | β | γ | Δ | ϵ | Average |
| RCT (lbf) | 33.4 | 33.7 | 35.4 | 35.7 | 39.5 | 35.54 |
| Treated 26# medium | | | | | | |
| Sample | 1 | 2 | 3 | 4 | 5 | Average |
| RCT (lbf) | 38.4 | 40.2 | 42.1 | 43.9 | 47.1 | 42.34 |
| Difference | 5.00 | 6.50 | 6.70 | 8.20 | 7.60 | 6.80 |
| % Increase | 15.0 | 19.3 | 18.9 | 23.0 | 19.2 | 19.1 |

TABLE VI

| Sample | 1 | 2 | 3 | 4 | 5 | Average |
|---|---|---|---|---|---|---|
| Untreated 26# medium | | | | | | |
| RCT (lbf) | 49.1 | 49.8 | 53.2 | 54.4 | 58.8 | 53.06 |
| Treated 26# medium | | | | | | |
| RCT (lbf) | 66.4 | 69.0 | 69.5 | 72.6 | 75.4 | 70.58 |
| Difference | 17.30 | 19.20 | 16.30 | 18.20 | 16.60 | 17.52 |
| % Increase | 32.5 | 38.6 | 30.6 | 33.5 | 28.2 | 33.0 |

Thus, significant improvements are made in both MD and CD Ring Crush Tests when RPC-1 is added to 26# 100% recycled medium. Specifically, when the RPC is utilized an increase of 30% can be observed over industry norms without any treatment. Table V additionally demonstrates a significant and unexpected increase in tensile strength of 19.1%.

In order to achieve the treated medium according to the invention, a two-part process is preferred. Specifically, at the wet end, the AKD is added, preferably in an amount of between 1 and 10, typically 3.5, dry pounds per ton of stock. Typical AKD is commonly available in the market as KEYDIME C125, an allyl ketene dimmer stabilized with cationic starch, specially formulated for use with micro and nanoparticle systems and available from EKA Chemicals of Bohus, Sweden. This particular AKD also exhibits self retentive characteristics and high efficiency and withstands elevated wet end temperatures.

Later during the process, for example, at the size press or calender stack, a second treatment may be performed. In a preferred embodiment, this second treatment includes the application of a blend of acrylate (0.5-2 lbs./1000 $ft^2$, typically 1 lbs./1000 $ft^2$ of paper produced) with a synthetic polyethylene (1-20%, typically 10% wt.), a cross-linking agent, such as zinc oxide (0.1-10%, typically 3% wt.). The remainder of the additive used in the second treatment is typically a solvent, preferably water. Typical acrylates include methylmethacylate, sold as Gellner K-21, available from Gellner & Co. of Gillette, N.J. Typical repulpable synthetic polyethylenes are sold under the tradenames JONWAX 22, JONWAX 26, JONWAX 28 and JONWAX 120, each of which is available from Johnson Wax Specialty Chemicals of Racine, Wis.

However, it is additionally considered within the scope of the invention to eliminate the size press or calender stack application, in favor of a modified wet end application (WEGP). In one embodiment, the acrylic containing resin (e.g., 10-40 dry lbs./ton) and the AKD (1-20 dry lbs./ton) are added at the wet end. A preferred WEGP comprises Gellner K-21 (20 or 35 dry lbs/ton) as the acrylic resin and Keydime 125C (7 dry lbs./ton) as the AKD component. Other typical WEGP compositions include from approximately 15-40 dry lbs./ton of the Gellner K-21 containing resin and from approximately 2-10 dry lbs/ton of the AICD, e.g., Keydime 125C, for example 35 or 20 dry lbs./ton acrylic containing resin with 7 dry lbs./ton AKD.

Experiments have shown that medium treated with this process has shown moisture resistance at least as great as conventional cascade-coated wax medium. Additionally, the "wet-end only" treated medium (WEGP) performs equal with respect to moisture resistance when compared to the "wet-end plus calender stack" treated medium described above. For example, surface water absorption over 30 seconds, expressed in g/m$^2$, measured by Cobb Test (see TAPPI T 441, herein incorporated by reference in its entirety), ring crush test and Concora tests (see TAPPI T 809, herein incorporated by reference in its entirety) show such properties. Moreover, by eliminating the calender stack treatment, the paper machine is permitted to run at a higher rate, because if the RPC is added into the wet end and not at the calender or size press, the machine speeds can double. Table VII, below, compares the WEGP chemical medium, wherein each test is run according to the standards as described by the respective TAPPI test method, each of which is herein incorporated by reference in its entirety.

TABLE VII

| | T 441 - Cobb Test 120 seconds (avg. g/m$^2$) | | T 460 - Porosity Gurley (avg s/100 air) | | T 410 | | T 411 Caliper |
|---|---|---|---|---|---|---|---|
| | Top Side | Wire Side | Top Side | Wire Side | Grammage (avg. g/m$^2$) | Basis Wt. (#/1000 ft$^2$) | (avg In $^1/_{1000}$ inch) |
| WEGP AKD | 31.33 | 28.93 | 23.56 | 23.12 | 152.96 | 31.36 | 0.01 |
| WEGP AKD size press | 27.85 | 29.54 | 26.76 | 27.57 | 160.09 | 32.82 | 0.01 |

The following RPC (RPC-2) was used in the "WEGP AKD size press" example of Table VII: JONCRYL 82 (60% wt.); JONCRYL 61LV (20%); zinc oxide (3%), ammonium hydroxide (3%); JONWAX 28 (5%), with the remainder being water to dilute the RPC to the desired viscosity. JONCRYL 82 is a heat-resistant polymer available from Johnson Wax Specialty Chemicals. JONCRYL 61LV is an acrylic acid containing resin composition available from Johnson Wax Specialty Chemicals, and includes JONCRYL 678, available from Johnson Wax Specialty Chemicals, (35.0 wt %), ammonia 28% (7.5 wt %), ethylene glycol (0.15% wt %) isopropyl alcohol (5.0 wt %) water (51.0 wt %), and optionally blended with one or more acrylic acid containing resins.

The following RPC (RPC-3) was used in the "WEGP AKD" example of Table VII: Gellner K-21 (35 dry lbs./ton) and Keydime C125 (7 dry lbs./ton).

As used in Table VII, WEGP AKD is used in the wet-end of the paper making process because it is cationic. In contrast, the size press composition utilizes a non-ionic polymer, to be used in the size press. Thus, it can be seen the WEGP size press medium exhibits less water absorption in the Cobb test, less porosity in the Gurley test and is slightly higher in the Grammage and Basis Weight results when compared to the WEGP AKD medium.

Typical liners produced in accordance with the invention are subjected to a rod coating first process and a top coating second process. In the first process, a blend of 1 lbs./1000 ft$^2$ and 50% styrene-butadiene rubber latex (50% wt.) is added along with the following composition:

| Component | Amount |
|---|---|
| JONCRYL 82 | 40-70%, preferably 60% wt. |
| Acrylic | 5-30%, preferably 20% |
| Crosslinking agent | 0.5-10%, preferably 3% |
| Ammonium hydroxide | 0.5-10%, preferably 3% |
| Polyethylene | 0.5-10%, preferably 5% |
| Water | Remainder |

Thereafter, the top coating process is performed with an RPC similar to the RPC used in the first process. Specifically, the RPC of the second process is lacking the latex.

A typical acrylic is JONCRYL 61LV from Johnson Wax Specialty Chemicals, a 33% ammonia solution of an acrylic resin. The crosslinking agent as discussed above, is typically zinc oxide, while the polyethylene is preferably JONWAX 28, a repulpable fine particle polyethylene emulsion, added merely for slip benefit for when the product is being processed in the machines. Although many synthetic polyethylenes are classified as "waxes", the low level of polyethylene added according to the present invention is not sufficient to perform as a conventional wax. In contrast, conventional wax coatings employ much higher levels of natural wax, such as paraffin wax, often in amounts greater than 6 dry lbs/ton.

The following is a typical RPC, utilized in the first process (hereinafter RPC-1): methylmethacrylate (35 dry lbs/ton) zinc oxide (3% wt.), and Keydime 125C (3.5 dry lbs./ton). Preferably, use of RPC-1 is followed by an application of 10% wt. of the Jonwax 22 synthetic repulpable wax. Optionally, a starch such as corn starch is included up to 4% wt.

As detailed above, it is advantageous to include cationic particles in the coating composition according to the present invention. Such cationic particles may be inorganic (such as salts) or organic (such as monomers or polymers). Additionally, non-ionic and anionic polymers with artificial charges of a cationic nature may be employed. In other words, when a non-cationic material is introduced into the wet end, a retention aid is typically premixed with the non-cationic material to cause it to bond more successfully with the naturally anionic fiber may be used to suspend the cationic particle and activate bonding to the anionically charged fiber. Such charged particle systems may be used in combination as, with or in lieu of, the acrylic containing resin and/or ASA/AKD additives detailed above, and can be applied at any stage of the paper making process, e.g., in the wet end, at the calender stack or as a coating following production of the paper product. Thus, the use of a cationic polymer, i.e., without a retention aid, results in a product that is more effective than such typical products requiring such a retention aid. Typical particles have a molecular weight number average between about 10,000 and 100,000, typically about 30,000-50,000. However, the preferred cationic material is Gellner OTTOPOL K21 from Gellner & Co., an acrylic copolymer, and Poly Emulsion 392C30, a cationic emulsion of high density polyethylene from GenCor or Chester, N.Y.

For example, the cationic material may include the acrylic containing resin. Suitable cationic acrylic resins include STH-55, manufactured by Mitsubishi Yuka Fine, Japan; and BASOPLAST 265 D, available from BASF Corporation of Mount Olive, N.J.

Additionally, the cationic material may be a cationic wax to enhance the wet resistances generated in the wet end. Such formulations are substantially similar to RPC-1, wherein approximately 1-approximately 20% of the formulations is the cationic wax, such as a synthetic polyethylene wax. Preferably, the cationic wax makes up approximately 2-approximately 18, and more preferably, approximately 4.0-approximately 16—0.0% of the RPC.

Although the present invention has been described in terms of specific embodiments, it will be apparent to one skilled in the art that various modifications may be made according to those embodiments without departing from the scope of the applied claims and their equivalents. Accordingly, the present invention should not be construed to be limited to the specific embodiments disclosed herein.

We claim:

1. A process for making a repulpable, grease and water resistant paper selected from the group consisting of Kraft, linerboard, medium and combinations thereof, having improved wet strength, the process comprising: depositing a furnish on a wire and dewatering the furnish to form a paper selected from the group consisting of Kraft, linerboard, medium and combinations thereof, subsequently pressing the dewatered paper a number of times to further reduce the water content of the paper, adding to the pressed paper selected from the group consisting of Kraft, linerboard, medium and combinations thereof, a mixture comprising an effective amount of a methyl methacrylate containing composition, the composition consisting of at least one member selected from the group consisting of alkyl ketene dimer, alkenyl ketene dimer, alkyl succinic anhydride and alkenyl succinic anhydride, a blend of methyl methacrylate with a synthetic polyethylene, a crosslinking agent for the methyl methacrylate, and a solvent, to at least one side of the dewatered paper subsequent to a first pressing step, wherein the methyl methacrylate containing composition is applied in an amount between approximately 0.5-2.2 dry lbs methyl methacrylate containing composition per 1000 $ft^2$ of paper yielding an edge crush (as measured by TAPPI Test Method T 811) of at least 74.9% retention.

2. The process of claim 1 further compising the step of adding to the furnish at least one member selected from the group consisting of (a) alkyl ketene dimer (b) alkenyl ketene dimer, (c) alkyl succinic anhydride and (d) alkenyl succinic anhydride.

3. The process of claim 2, wherein the member is alkyl ketene dimmer.

4. The process of claim 1, wherein the crosslinking agent is at least one selected from the group consisting of zinc oxide, ammonium oxide, calcium oxide, calcium stearate, magnesium stearate, aluminum oxide, isostearate, magnesium oxide, stannous oxide, tungsten oxide, sodium tungstate, sodium tungstate dihydrate, titanium oxide, aluminum stearate, zinc octoate, zinc salts of fatty acids, zirconium oxide, calcium isosterate, calcium salts of fatty acids, magnesium salts of fatty acids, and aluminum salts of fatty acids.

5. The process of claim 1, wherein the composition is introduced to both sides of the paper.

6. The process of claim 1, wherein the crosslinking agent is present in a amount of 0.1-3% by weight, based on the total weight of the methyl methacrylate containing composition, synthetic polyethylene, crosslinking agent and solvent.

7. The process of claim 1, wherein the solvent is water.

8. The process of claim 1, wherein the crosslinking agent is inorganic.

9. The process of claim 1, wherein the polyethylene is present as a repulpable fine particle size polyethylene emulsion.

10. The process of claim 1, wherein the mixture further comprises a mineral additive from the group consisting of Alumina-Silica, calcium carbonate and titanium dioxide.

11. The process of claim 2, wherein the paper is medium.

* * * * *